US011629566B2

(12) United States Patent
Fripp et al.

(10) Patent No.: US 11,629,566 B2
(45) Date of Patent: Apr. 18, 2023

(54) SYSTEMS AND METHODS FOR POSITIONING AN ISOLATION DEVICE IN A BOREHOLE

(71) Applicant: HALLIBURTON ENERGY SERVICES, INC., Houston, TX (US)

(72) Inventors: Michael Linley Fripp, Carrollton, TX (US); Matthew Taylor Nichols, Carrollton, TX (US); Zachary William Walton, Edmond, OK (US); Matthew Todd Howell, Tomball, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 54 days.

(21) Appl. No.: 16/490,340

(22) PCT Filed: Dec. 4, 2018

(86) PCT No.: PCT/US2018/063750
§ 371 (c)(1),
(2) Date: Aug. 30, 2019

(87) PCT Pub. No.: WO2020/117208
PCT Pub. Date: Jun. 11, 2020

(65) Prior Publication Data
US 2021/0324694 A1 Oct. 21, 2021

(51) Int. Cl.
*E21B 23/04* (2006.01)
*E21B 33/128* (2006.01)

(52) U.S. Cl.
CPC ..... *E21B 23/04* (2013.01); *E21B 33/128* (2013.01)

(58) Field of Classification Search
CPC ..... E21B 23/04; E21B 33/126; E21B 33/1265
See application file for complete search history.

(56) References Cited

U.S. PATENT DOCUMENTS

| | | | | |
|---|---|---|---|---|
| 1,730,804 | A * | 10/1929 | Christenson, Jr. | E21B 33/126 92/241 |
| 2,275,935 | A * | 3/1942 | Baker | E21B 33/1295 166/131 |
| 2,578,900 | A * | 12/1951 | Ragan | E21B 33/1265 166/119 |
| 5,117,910 | A * | 6/1992 | Brandell | E21B 33/126 166/154 |
| 7,246,660 | B2 | 7/2007 | Fripp et al. | |
| 9,074,439 | B2 | 7/2015 | Vanlue | |
| 9,316,086 | B2 | 4/2016 | Vanlue | |
| 2005/0241835 | A1* | 11/2005 | Burris, II | E21B 23/00 166/313 |

(Continued)

OTHER PUBLICATIONS

International Search Report and Written Opinion dated Aug. 14, 2019, of PCT/US2018/063750, filed on Dec. 4, 2018.

*Primary Examiner* — Cathleen R Hutchins
(74) *Attorney, Agent, or Firm* — K&L Gates LLP

(57) ABSTRACT

A borehole isolation device. The borehole isolation device may include a body having an outer diameter and an expandable ring. The expandable ring may be configured to expand from a first outer diameter that is approximately equal to or smaller than the outer diameter of the body to a second outer diameter that is greater than the outer diameter of the body when a fluid is flowed past the expandable ring in the borehole.

24 Claims, 8 Drawing Sheets

(56) References Cited

U.S. PATENT DOCUMENTS

| | | | | |
|---|---|---|---|---|
| 2011/0308820 | A1* | 12/2011 | Greenlee | E21B 33/1295 166/387 |
| 2013/0264056 | A1 | 10/2013 | Stout | |
| 2014/0311752 | A1 | 10/2014 | Streich et al. | |
| 2015/0247375 | A1 | 9/2015 | Stout | |
| 2015/0361756 | A1 | 12/2015 | Frazier | |
| 2016/0060999 | A1* | 3/2016 | Avanashiappan | E21B 33/126 166/387 |
| 2016/0097252 | A1 | 4/2016 | Resink | |
| 2017/0234108 | A1 | 8/2017 | Xu | |
| 2020/0048981 | A1* | 2/2020 | Coon | E21B 33/129 |

* cited by examiner

SYSTEMS AND METHODS FOR POSITIONING AN ISOLATION DEVICE IN A BOREHOLE

BACKGROUND

This section is intended to provide relevant background information to facilitate a better understanding of the various aspects of the described embodiments. Accordingly, it should be understood that these statements are to be read in this light and not as admissions of prior art.

Boreholes are drilled into the earth for a variety of purposes including accessing hydrocarbon bearing formations. A variety of downhole tools may be used within a borehole in connection with accessing and extracting such hydrocarbons. Throughout the process, it may become necessary to isolate sections of the borehole using borehole isolation devices, such as frac plugs, bridge plugs, packers, and other suitable tools, may be used to isolate borehole sections.

Frac plugs and other zonal isolation devices are commonly pumped through the borehole on a tool string such as a wireline, work string, or production tubing for performing a treatment operation. Such downhole tools typically have either an internal or external setting tool, which is used to set the downhole tool within the borehole and hold the tool in place once located at a target location. Upon reaching the target location within the borehole, the downhole tool is actuated by hydraulic, mechanical, electrical, electromechanical, or any other suitable means to seal off the flow of liquid around the downhole tool. However, current frac plugs and other zonal isolation devices can be time consuming to pump down the borehole, increasing the total time of the treatment operation. Additionally, a large amount of fluid is typically necessary to pump the frac plug or other zonal isolation device downhole. Additionally, increasing the velocity of the fluid pumped downhole may cause the frac plug or zonal isolation device to detach from the setting tool, requiring a new frac plug or zonal isolation device to be run downhole.

Accordingly, there exists a need for an improved system and method for pumping a frac plug or other isolation device down into a borehole.

BRIEF DESCRIPTION OF THE DRAWINGS

Embodiments of the system for positioning an isolation device in a borehole are described with reference to the following figures. The same numbers are used throughout the figures to reference like features and components. The features depicted in the figures are not necessarily shown to scale. Certain features of the embodiments may be shown exaggerated in scale or in somewhat schematic form, and some details of elements may not be shown in the interest of clarity and conciseness.

DETAILED DESCRIPTION

The present disclosure provides systems and methods for positioning an isolation device in a borehole. The systems and methods may be used to reduce the amount of fluid that is necessary to pump the isolation device down the borehole.

A main borehole may in some instances be formed in a substantially vertical orientation relative to a surface of the well, and a lateral borehole may in some instances be formed in a substantially horizontal orientation relative to the surface of the well. However, reference herein to either the main borehole or the lateral borehole is not meant to imply any particular orientation, and the orientation of each of these boreholes may include portions that are vertical, non-vertical, horizontal or non-horizontal. Further, the term "uphole" refers a direction that is towards the surface of the well, while the term "downhole" refers a direction that is away from the surface of the well.

Figure 1:
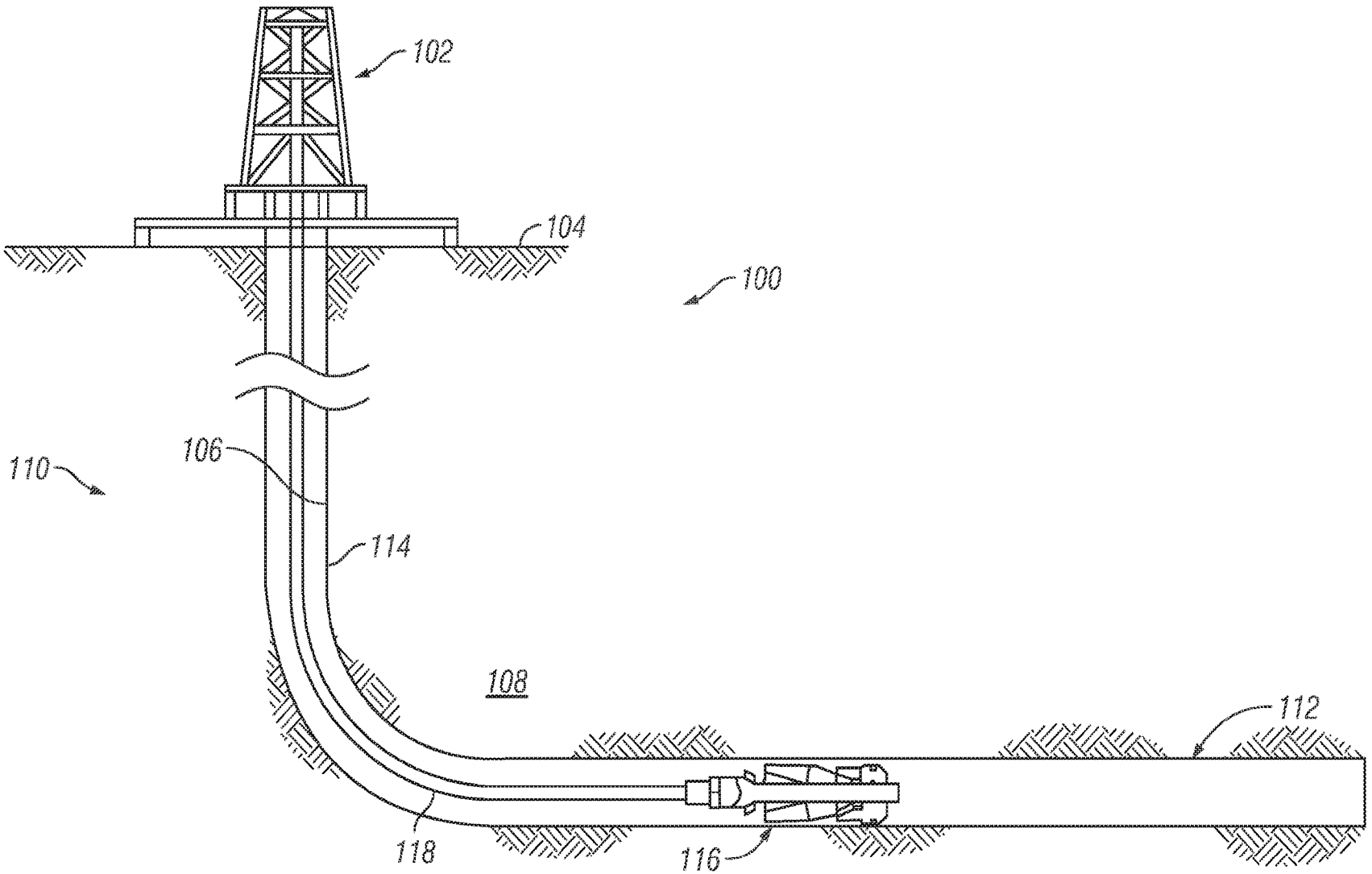
FIG. 1 is a partial cross-sectional diagram of a well system, according to one or more embodiments disclosed.

FIG. 1 is a cross-sectional diagram of a well system 100, according to one or more embodiments disclosed. As illustrated, the well system 100 may include a service rig 102 that is positioned on the Earth's surface 104 and extends over and around a borehole 106 that penetrates a subterranean formation 108. The service rig 102 may be a drilling rig, a completion rig, a workover rig, or any other type of rig used in oil and gas operations. In some embodiments, the service rig 102 may be replaced with a standard surface wellhead completion or installation. While the well system 100 is depicted as a land-based operation, it will be appreciated that the principles of the present disclosure could equally be applied in any sea-based or sub-sea application where the service rig 102 may be a floating platform or sub-surface wellhead installation.

The borehole 106 is drilled into the subterranean formation 108 using any suitable drilling technique and extends in a substantially vertical direction away from the Earth's surface 104 over a vertical borehole portion 110. At some point in the borehole 106, the vertical borehole portion 110 may deviate from vertical and transition into a deviated borehole portion 112 that may be, for example, substantially horizontal, although such deviation is not required. In other embodiments, the borehole 106 may be vertical, horizontal, or deviated. In some embodiments, the borehole 106 may be supported by cementing casing 114 within the borehole 106. The casing 114 may extend through the entire length of the borehole 106 or through only a portion of the borehole 106. As used herein, the term "casing" refers not only to casing as generally known in the art, but also to borehole liner, which comprises tubular sections coupled end to end but not extending to a surface location. In other embodiments, however, the casing 114 may be omitted from all or a portion of the borehole 106 and the principles of the present disclosure may equally apply to an "open-hole" environment.

The well system 100 further includes a borehole isolation device 116 as described in more detail below. The borehole isolation device 116 is conveyed into the borehole 106 on a conveyance 118 that extends from the service rig 102. The conveyance 118 that delivers the borehole isolation device 116 downhole may be, but is not limited to, wireline, slickline, an electric line, coiled tubing, drill pipe, production tubing, or the like. The borehole isolation device 116 is conveyed downhole to a target location (not shown) within the borehole 106 and then is actuated or "set" to seal the borehole 106 and otherwise provide a point of fluid isolation within the borehole 106.

Hydraulic fluid is pumped downhole from the service rig 102 at the surface 104 to apply a fluid pressure to the borehole isolation device 116 to move or help move the borehole isolation device 116 to the target location. The conveyance 118 controls the movement of the borehole isolation device 116 as it traverses the borehole 106 and provides the necessary power to actuate and set the borehole isolation device 116 upon reaching the target location.

It will be appreciated by those skilled in the art that even though FIG. 1 depicts the borehole isolation device 116 as arranged and operating in the horizontal portion 112 of the borehole 106, the embodiments described herein are equally applicable for use in portions of the borehole 106 that are vertical, deviated, or otherwise slanted. It should also be noted that a plurality of borehole isolation devices 116 may be placed in the borehole 106 to divide the borehole 106 into smaller intervals or "zones" for hydraulic stimulation.

Figure 2:
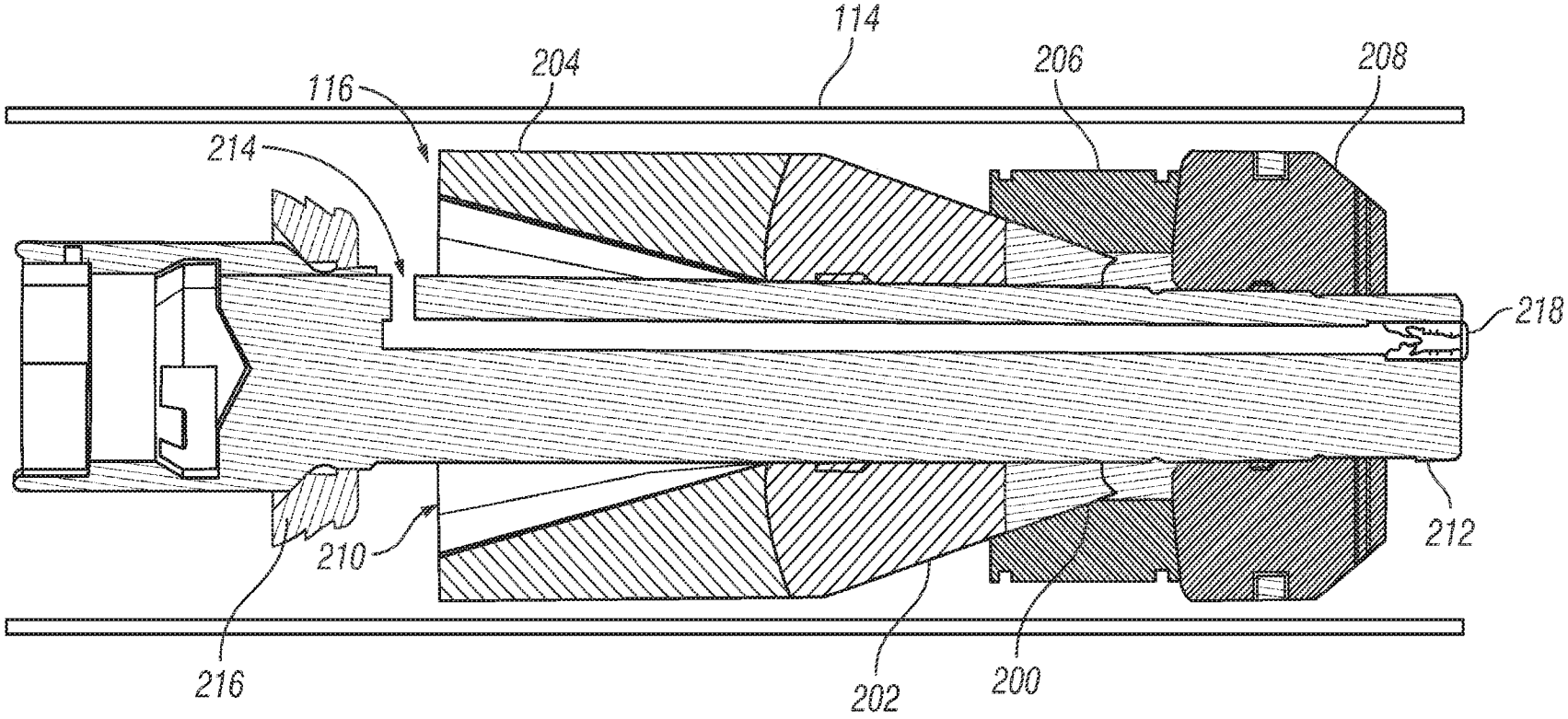
FIG. 2 is a cross-sectional diagram of the borehole isolation device of FIG. 1.

FIG. 2 is a cross-sectional diagram of the borehole isolation device 116 of FIG. 1. The borehole isolation device 116 includes a body 200, a wedge 202, an expandable ring 204 coupled to the wedge 202, and slips 206. In at least one embodiment, the expandable ring 204 is integrally formed with the wedge 202. The body 200 of the borehole isolation device 116 is coupled to a mule shoe 208 that helps to center the borehole isolation device 116 within the casing 114 and remove debris from the path of the borehole isolation device 116 as it travels downhole. In some embodiments, the mule shoe 208 may be integrally formed with the body 200 or the mule shoe 208 may be omitted. In at least one embodiment, the expandable ring 204 is made of a dissolvable material, such as, but not limited to, polyurethane, PGA, PLA, or an aliphatic polyester. In other embodiments, additional components of borehole isolation device 116 or the entire borehole isolation device 116 may be made of dissolvable materials. The dissolvable materials may be dissolved via solubilization, hydrolytic degradation, biologically formed entities (e.g., bacteria or enzymes), chemical reactions (including electrochemical and galvanic reactions), thermal reactions, reactions induced by radiation, or combinations thereof. The use of the dissolvable materials may allow the set borehole isolation device 116 to be removed without the need for drilling or milling, or to reduce the time required to mill or drill through the borehole isolation device 116.

The outer diameter of the expandable ring 204 is approximately equal to or smaller than the outer diameter of the body 200 and/or mule shoe 208. As used herein, an approximate dimension is a dimension that is within 10% of the target dimension. Further, an exact dimension is a dimension that is within the accepted manufacturing tolerance for the industry. The acceptable tolerance is typically 0.010 inches (0.254 mm), however the acceptable tolerance may vary depending on the intended application of the component.

The borehole isolation device 116 includes a central bore 210 that allows the borehole isolation device 116 to be positioned on a setting tool 212 that includes an internal bypass fluid flowpath 214. In some embodiments, the cross-sectional area of the bypass fluid flowpath 214 may be 0.01 square inches to 3 square inches. In other embodiments, the cross-sectional area of the bypass fluid flowpath 214 may be larger than 3 square inches. The setting tool 212 is also coupled to the conveyance 118 and retains the borehole isolation device 116 on the conveyance 118 as the borehole isolation device 116 is positioned within the borehole 106. The setting tool 212 also includes a seat 216 that expands the expandable ring 204 to create a seal between the expandable ring 204 and the inner surface of the casing 114, as described in more detail below. As used herein, a seal is a restriction in a fluid passage that limits or prevents the flow of fluid through at least a portion of the fluid passage.

Figure 3:
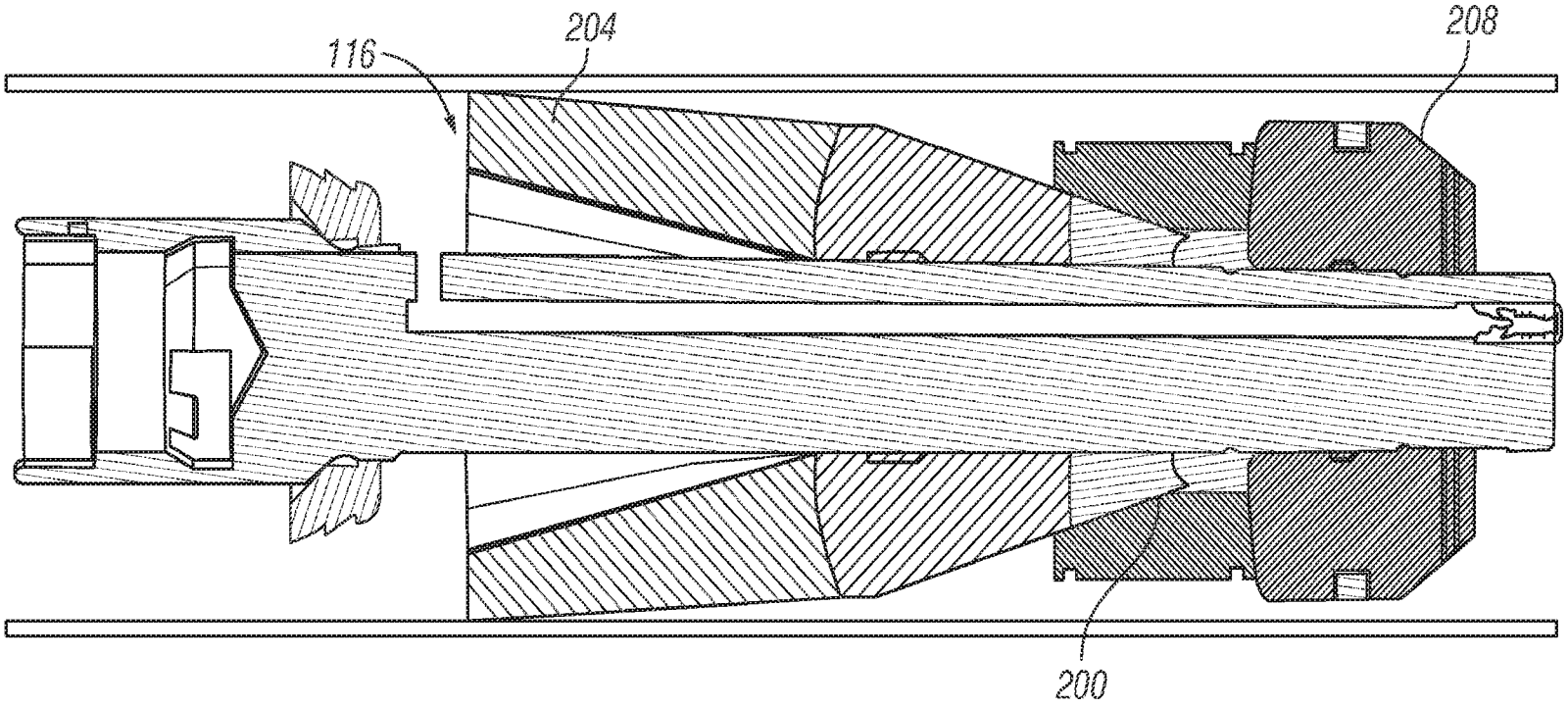
FIG. 3 is a cross-sectional diagram of the borehole isolation device of FIG. 2 with the expandable ring expanded.

As previously discussed, fluid pressure is applied to the borehole isolation device 116 as it is conveyed downhole by the conveyance 118 so as to flow a portion of the fluid past the borehole isolation device 116. As shown in FIG. 3, the pressure differential across the borehole isolation device 116 causes the expandable ring 204 to expand to an outer diameter of that is greater than the outer diameter of the body 200 and/or mule shoe 208. Once expanded, the expandable ring 204 contacts and at least partially seals against the inner surface of the casing 114. The seal between the expandable ring 204 and the casing 114 restricts flow of at least some of the fluid, thus pumping the borehole isolation device 116 through the borehole using less fluid compared to a borehole isolation device without an expandable ring. For example, a typical borehole isolation device (not shown) allows about 50% of the fluid pumped downhole from the service rig 102 to flow past the borehole isolation device. However, the expandable ring, once expanded, allows 10% or less of the fluid to flow past the borehole isolation device 116.

The borehole isolation device 116 may further include a pressure control device 218 in the internal bypass fluid flowpath 214 to control the pressure differential across the expandable ring 204 once the expandable ring 204 is expanded. The pressure control device 218 may be, for example, a pressure relief valve, a check valve, a rupture disc, a flapper valve, or other similar device that allows for control of the amount of fluid passing through the internal bypass fluid flowpath 214. Such pressure control devices 218 may remain closed until a required fluid pressure is reached to control the pressure differential across the expandable ring 204. This ensures that excessive pressure on the uphole side of the borehole isolation device 116 does not cause the borehole isolation device 116 to detach from the setting tool as the borehole isolation device 116 is positioned downhole. The pressure control device 218 may also be a restrictor, a screen, a nozzle, a vortex, or other similar device that includes a fixed orifice for the fluid to pass through, preventing a pressure build-up that may cause the borehole isolation device 116 to detach from the setting tool as the borehole isolation device 116 is positioned downhole.

Figure 4:
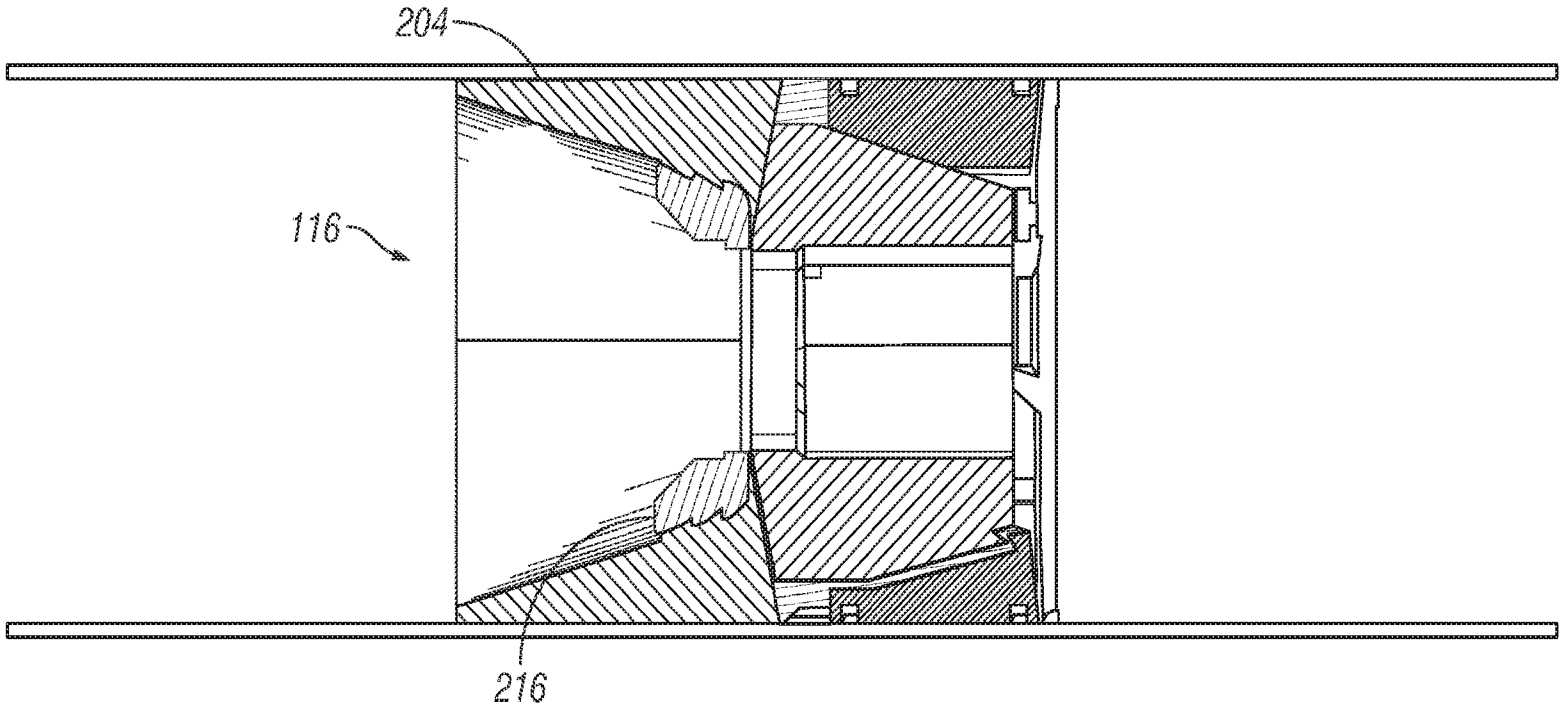
FIG. 4 is a cross-sectional diagram of the borehole isolation device of FIG. 2 in a set position within the casing.

The borehole isolation device 116 is pumped through the borehole until the borehole isolation device 116 reaches the target location. At this point, the pumping of fluid downhole is stopped and the expandable ring 204 returns to the non-expanded outer diameter. The setting tool 212 then begins to shift the seat 216 towards the body 200. The seat 216 expands the expandable ring 204 to create a seal between the expandable ring 204 and the inner surface of the casing 114. The setting tool 212 positions the seat 216 a sufficient distance within the expandable ring 204 to ensure that the seal is maintained once the setting tool 212 is withdrawn from the borehole 106, as shown in FIG. 4.

Figure 5:
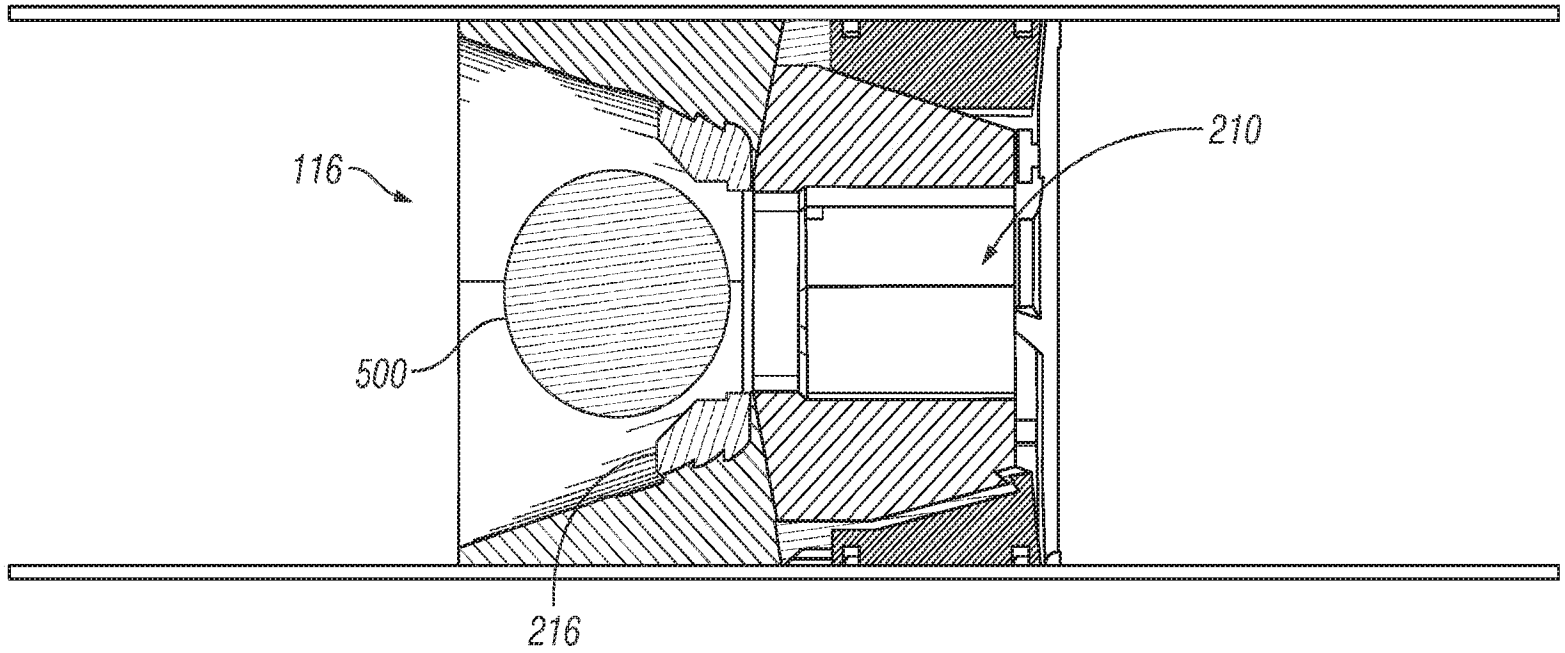
FIG. 5 is a cross-sectional diagram of the borehole isolation device of FIG. 2 with a sealing ball installed.

After the seat 216 is positioned within the expandable ring 204, the wedge and slips are compressed towards each other, expanding the slips to engage with the inner surface of the casing 114 and retain the borehole isolation device 116 within the borehole 106. The setting tool 212 is then disengaged from the borehole isolation device 116 and withdrawn from the borehole 106. Once the setting tool 212 is removed, a sealing ball 500 or sealing dart (not shown) is pumped downhole to contact and seal against the seat 216, preventing fluid from passing through the central bore 210 of the borehole isolation device 116, as shown in FIG. 5.

Figure 6:
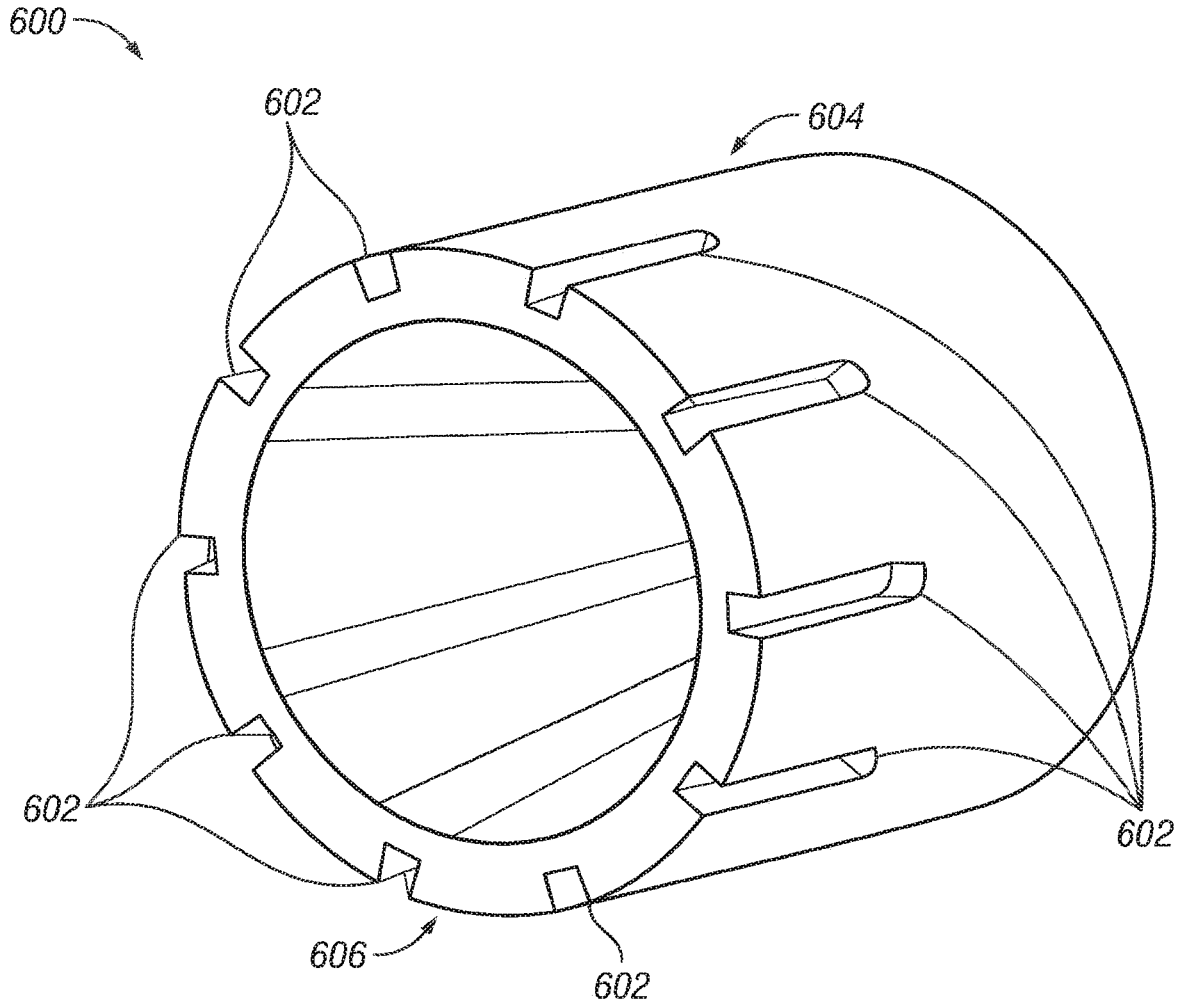
FIG. 6 is an isometric view of an expandable ring for a borehole isolation device, according to one or more embodiments disclosed.

FIG. 6 is an isometric view of an expandable ring 600 for a borehole isolation device, according to one or more embodiments disclosed. The expandable ring 600 may be used in place of the expandable ring 204 of the borehole isolation device 116 shown in FIGS. 1 and 2. Accordingly, similar elements will not be described again in detail, except as where necessary for the understanding of the expandable ring 600 shown in FIG. 6. Further, the functions of the expandable ring 600 are described with reference to the functions of the borehole isolation device 116 shown in FIGS. 1 and 2.

As shown in FIG. 6, the expandable ring 600 includes flutes 602 that are circumferentially spaced around the outer surface 604 of the expandable ring 600. The flutes 602 extend longitudinally from an uphole end portion 606 of the expandable ring 600 and extend radially inward from the outer surface 604 of the expandable ring 600. In the exemplary embodiment, the flutes 602 extend radially inward through only a portion of the expandable ring 600. In other embodiments, the flutes 602 may extend through the entire thickness of the expandable ring 600. Although ten flutes 602 are shown in FIG. 6, additional embodiments may include fewer flutes 602 or an increased number of flutes 602 that are circumferentially spaced around the outer surface 604 of the expandable ring 600. Further, in some embodiments, the flutes 602 may not be equally spaced around the circumference of the expandable ring. 600.

As previously discussed, the expandable ring 600 expands to contact and at least partially seal against the inner surface of the casing 114 when fluid is pumped from the service rig 102 to convey the borehole isolation device 116 downhole. By extending from the uphole end portion 606, the flutes 602 create multiple fluid paths that allow fluid to bypass the seal between the expandable ring 600 and the casing 114, controlling the pressure differential across the expandable ring 600 as the borehole isolation device 116 is conveyed downhole. Similar to the bypass fluid flowpath 214 discussed above, the combined cross-sectional area of the multiple fluid paths may be 0.01 square inches to 3 square inches. In other embodiments, the combined cross-sectional area of the multiple fluid paths may be larger than 3 square inches. The expandable ring 600 can be used with a setting tool 212 that may or may not include an internal bypass fluid flowpath 214.

Once a borehole isolation device 116 that includes the expandable ring 600 reaches the target location within the borehole 106 and fluid is no longer pumped downhole, the expandable ring 600 contracts to the initial outer diameter. A seat 216 then expands the expandable ring 600, as previously described, to create a seal between the expandable ring 600 and the inner surface of the casing 114. The seat 216 is positioned within the expandable ring 600 such that the seal is created between the casing 114 and a portion of the expandable ring 600 that is longitudinally outside of the flutes 602. This ensures that the flutes 602 do not create a fluid bypass once the borehole isolation device 116 is set at the target location within the borehole 106.

Figure 7:
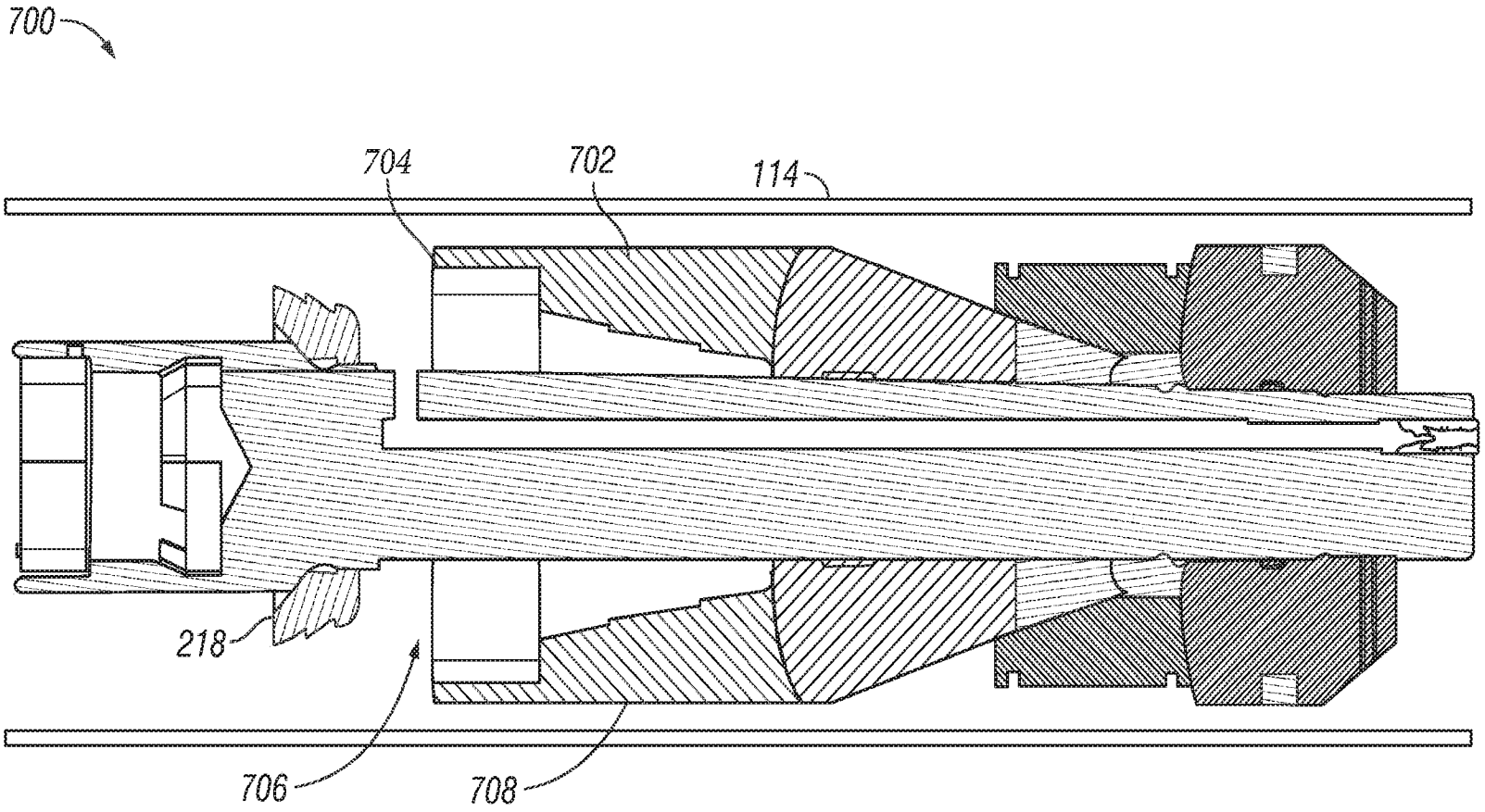
FIG. 7 is a cross-sectional diagram of a borehole isolation device, according to one or more embodiments disclosed.

FIG. 7 is a cross-sectional diagram of a borehole isolation device 700, according to one or more embodiments disclosed. The borehole isolation device 700 includes many elements that are similar to the elements described above in relation to the borehole isolation device 116 shown in FIGS. 1 and 2. Further, the functions of these elements are similar to those described above in relation to the borehole isolation device 116 shown in FIGS. 1 and 2. Accordingly, similar elements will not be described again in detail, except as where necessary for the understanding of the borehole isolation device 700 shown in FIG. 7.

As shown in FIG. 4, the expandable ring 702 includes a portion 704 having a reduced thickness. The reduced thickness portion extends longitudinally from an uphole end portion 706 of the expandable ring 702 before transitioning into a frustoconical portion 708. In other embodiments, the reduced thickness portion 704 may transition into a cylindrical portion (not shown). The reduced thickness lowers the hoop stiffness of the expandable ring 702, allowing the expandable ring 702 to expand a lower fluid pressure and flow rate than would otherwise be necessary.

Once the borehole isolation device 700 reaches the target location within the borehole 106 and fluid is no longer pumped downhole, the expandable ring 702 contracts to the initial outer diameter. A seat 216 then expands the expandable ring 702 to create a seal between the expandable ring 600 and the inner surface of the casing 114, as previously described. In at least one embodiment, the seat 216 is positioned within the expandable ring 702 such that the seal is created between the casing 114 and a portion of the expandable ring 702 that is longitudinally outside of the reduced thickness portion 704. In another embodiment, the seat 216 expands the reduced thickness portion 706 to create the seal.

Figure 8:
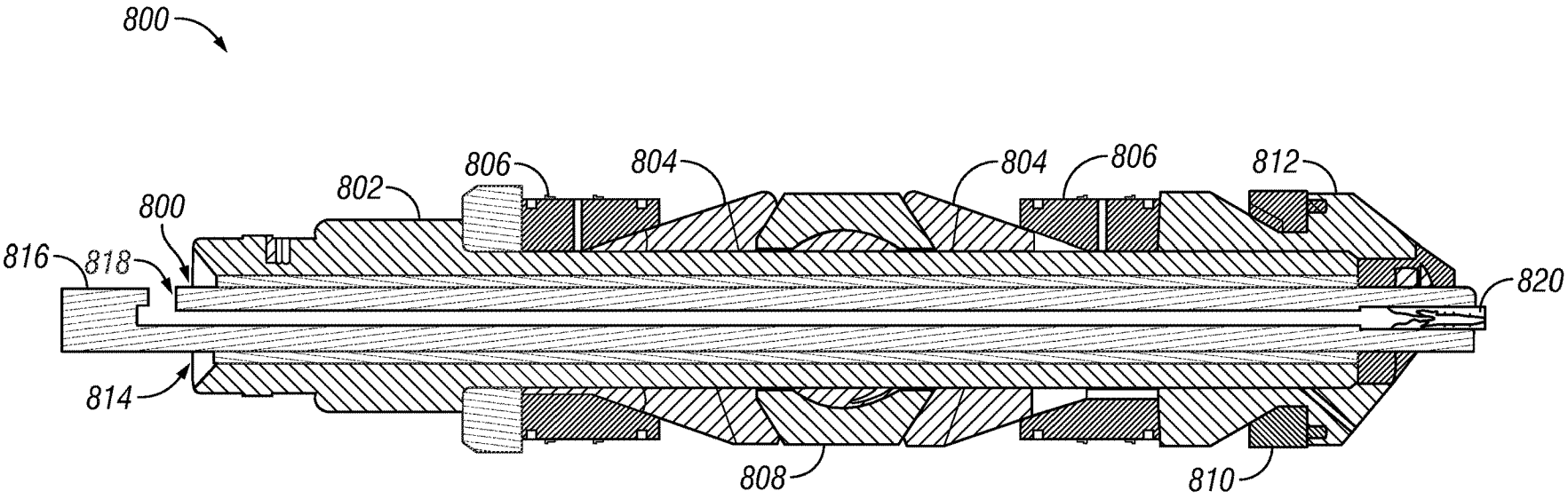
FIG. 8 is a cross-sectional diagram of a borehole isolation device, according to one or more embodiments disclosed.

FIG. 8 is a cross-sectional diagram of a borehole isolation device 800, according to one or more embodiments disclosed. The borehole isolation device 800 includes a body 802, wedges 804, slips, 806, a sealing element 808, an expandable ring 810, a mule shoe 812, and a central bore 814. Similar to the expandable rings 204, 600, 702 described above, the outer diameter of the expandable ring 810 is approximately equal to or smaller than the outer diameter of the body 802 and/or mule shoe 812. In at least one embodiment, the expandable ring 810 is made of a dissolvable material, such as, but not limited to, polyurethane, PGA, PLA, or an aliphatic polyester. In other embodiments, additional components of borehole isolation device 800 or the entire borehole isolation device 800 may be made of dissolvable materials.

As fluid is pumped downhole by the service rig 102 to conveying the borehole isolation device 800 to the target location within the wellbore 106, fluid pressure is applied to the borehole isolation device 800. As discussed above, a portion of the fluid flows past the borehole isolation device and the pressure differential created by the flowing fluid causes the expandable ring 810 to expand to an outer diameter of that is greater than the outer diameter of the body 802 and/or mule shoe 812. Once expanded, the expandable ring 810 contacts and at least partially seals against the inner surface of a casing (not shown). In at least one embodiment, the expandable ring 810 includes flutes 602 as shown in FIG. 3. In another embodiment, the expandable ring 810 includes a portion having a reduced thickness 704 as shown in FIG. 7. In further embodiments, the expandable ring 810 is similar to the expandable ring 204 shown in FIG. 2.

The borehole isolation device 800 is positioned on a setting tool 816 as it is conveyed downhole. In some embodiments, the setting tool 816 includes an internal bypass fluid flowpath 818 and a pressure control device 820 similar to those described above with reference to FIG. 2. In other embodiments, the pressure control device 820 and/or the internal bypass fluid flowpath 818 are omitted.

Once the borehole isolation device 800 reaches the target location within the borehole (not shown) and fluid is no longer pumped downhole, the expandable ring 810 contracts to the initial outer diameter. The setting tool 816 then compresses the borehole isolation device 800 to shift the slips 806 up the wedges 804 to expand the slips 806, retaining the borehole isolation device 800 within the casing. As this occurs, the wedges 804 also shift inward towards the sealing element 808, compressing the sealing element 808 and creating a seal between the sealing element 808 and the casing. The tool string and setting tool 816 can then be withdrawn from the borehole and a sealing ball or plug (not shown) can be pumped downhole to contact and seal against the body 802, preventing fluid from traveling through the central bore 814 of the borehole isolation device 800.

Certain embodiments of the disclosed invention may include a borehole isolation device for a borehole. The borehole isolation device may include a body having an outer diameter and an expandable ring. The expandable ring may be configured to expand from a first outer diameter that is approximately equal to or smaller than the outer diameter of the body to a second outer diameter that is greater than the outer diameter of the body when a fluid is flowed past the expandable ring in the borehole.

In certain embodiments of the borehole isolation device, the expandable ring may be expandable to create at least a partial seal between the borehole isolation device and an inner surface of the borehole or an inner surface of a casing in the borehole.

In certain embodiments of the borehole isolation device, the expandable ring may be further configured to contract from the second outer diameter towards the first outer diameter when the fluid flow stops.

In certain embodiments of the borehole isolation device, the borehole isolation device may include a dissolvable material.

In certain embodiments of the borehole isolation device, the body may include a mule shoe and the expandable ring may be coupled to the mule shoe.

In certain embodiments of the borehole isolation device, the expandable ring may include a reduced thickness section at an uphole end portion of the ring.

In certain embodiments of the borehole isolation device, the expandable ring may include flutes formed on an outer surface of the expandable ring.

In certain embodiments of the borehole isolation device, the combined cross-sectional area of the flutes may be between 0.01 square inches and 3 square inches.

In certain embodiments of the borehole isolation device, the borehole isolation device may include a sealing element and the expandable ring may be coupled to the sealing element.

Certain embodiments of the disclosed invention may include a well system for a borehole. The well system may include a tool string, a setting tool, a borehole isolation device, and a pressure control device. The tool string may be configured to travel through the borehole. The setting tool may be coupled to the tool string and include an internal bypass fluid flowpath. The borehole isolation device may be coupled to the setting tool and include a body having an outer diameter and an expandable ring. The expandable ring may be configured to expand from a first outer diameter that is approximately equal to or smaller than the outer diameter of the body to a second outer diameter that is greater than the outer diameter of the body when a fluid is flowed past the expandable ring. The pressure control device may be positioned within the internal bypass fluid flowpath and configured to control a pressure differential across the expandable ring.

In certain embodiments of the well system, the cross-sectional area of the internal bypass fluid flowpath may be between 0.01 square inches and 3 square inches In certain embodiments of the well system, the pressure control device may include a valve, a nozzle, a tube, or a rupture disc.

In certain embodiments of the well system, the well system may include a seat configured to expand the expandable ring to create at least a partial seal between the borehole isolation device and an inner surface of the borehole or a casing in the borehole.

In certain embodiments of the well system, the body of the borehole isolation device may include a mule shoe and the expandable ring may be operatively coupled to the mule shoe.

In certain embodiments of the well system, the borehole isolation device may include a dissolvable material.

In certain embodiments of the well system, the expandable ring may include a reduced thickness section at an uphole end portion of the expandable ring.

In certain embodiments of the well system, the expandable ring may include flutes formed on an outer surface of the expandable ring.

In certain embodiments of the well system, the combined cross-sectional area of the flutes may be between 0.01 square inches and 3 square inches.

In certain embodiments of the well system, the borehole isolation device may further include a sealing element and the expandable ring may be operatively coupled to the sealing element.

Certain embodiments of the disclosed invention may include a method. The method may include pumping a borehole isolation device coupled to a setting tool through a borehole by pumping a fluid in the borehole. The method may also include expanding an expandable ring of the borehole isolation device from a first outer diameter that is approximately equal to or smaller than an outer diameter of a body of the borehole isolation device to a second outer diameter that is greater than the outer diameter of the body using the pumped fluid. The method may further include controlling a fluid pressure across the expandable ring with a pressure control device of the borehole isolation device to control the velocity of the borehole isolation device as it is being pumped through the borehole.

In certain embodiments of the method, the pressure control device may include a valve, a nozzle, a tube, or a rupture disc.

In certain embodiments of the method, the method may further include expanding the expandable ring with a seat to create a seal between the borehole isolation device and an inner surface of the borehole or an inner surface of a casing in the borehole.

In certain embodiments of the method, the method may further include contracting the expandable ring from the second outer diameter towards the first outer diameter.

In certain embodiments of the method, expanding the expandable ring may include contacting and at least partially sealing the expandable ring against an inner surface of the borehole or an inner surface of a casing in the borehole.

In certain embodiments of the method, the expandable ring includes a reduced thickness section at an uphole end portion of the expandable ring.

In certain embodiments of the method, the expandable ring may include flutes formed on an outer surface of the expandable ring.

Certain terms are used throughout the description and claims to refer to particular features or components. As one skilled in the art will appreciate, different persons may refer to the same feature or component by different names. This document does not intend to distinguish between components or features that differ in name but not function.

Reference throughout this specification to "one embodiment," "an embodiment," "embodiments," "some embodiments," "certain embodiments," or similar language means that a particular feature, structure, or characteristic described in connection with the embodiment may be included in at least one embodiment of the present disclosure. Thus, these phrases or similar language throughout this specification may, but do not necessarily, all refer to the same embodiment.

The embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

What is claimed is:

1. A borehole isolation device conveyable into a borehole, the borehole isolation device comprising:

a body having an outer diameter; and an expandable ring is expandable from a first outer diameter that is approximately equal to or smaller than the outer diameter of the body to a second outer diameter that is greater than the outer diameter of the body due to a pressure differential of a fluid outside the body across the expandable ring being greater on the uphole end to create at least a partial seal between the borehole isolation device and an inner surface of the borehole or a casing in the borehole during conveyance to a location in the borehole.

2. The borehole isolation device of claim 1, wherein the expandable ring is further configured to contract from the second outer diameter towards the first outer diameter when the pressure differential decreases below the level required to create the at least partial seal.

3. The borehole isolation device of claim 1, wherein the borehole isolation device comprises a dissolvable material.

4. The borehole isolation device of claim 1, the body comprises a mule shoe and the expandable ring is coupled to the mule shoe.

5. The borehole isolation device of claim 1, wherein the expandable ring comprises a reduced thickness section at the uphole end portion of the expandable ring.

6. The borehole isolation device of claim 1, wherein the expandable ring comprises flutes formed on an outer surface of the expandable ring.

7. The borehole isolation devices of claim 6, wherein the combined cross-sectional area of the flutes is between 0.01 square inches and 3 square inches.

8. The borehole isolation device of claim 1, further comprising a sealing element and wherein the expandable ring is coupled to the sealing element.

9. The borehole isolation device of claim 1, wherein the borehole isolation device is conveyable in the borehole using a setting tool comprising an internal bypass fluid flowpath extending from the uphole end to a downhole end of the expandable ring and a seat, wherein the bypass fluid flowpath comprises a pressure control device configured to control the pressure differential across the expandable ring by controlling an amount of the fluid passing through the bypass fluid flowpath during the conveyance into the borehole and wherein the seat is movable relative to the expandable ring to expand the expandable ring to create a seal between the borehole isolation device and the inner surface of the borehole or the casing at the location.

10. A well system for a borehole, comprising:

a tool string configured to travel through the borehole;

a setting tool coupled to the tool string, the setting tool comprising an internal bypass fluid flowpath;

a borehole isolation device coupled to the setting tool, the borehole isolation device comprising:

a body having an outer diameter, an expandable ring configured such that an outermost portion of an uphole end portion is expandable from a first outer diameter to a second outer diameter that is greater than the first outer diameter due to a pressure differential of a fluid outside the body across the expandable ring being greater on the uphole end to create at least a partial seal between the borehole isolation device and an inner surface of the borehole or a casing in the borehole during conveyance to a location in the borehole;

a pressure control device positioned within the internal bypass fluid flowpath and configured to control the pressure differential across the expandable ring by controlling an amount of the fluid passing through the bypass fluid flowpath during the conveyance into the borehole;

a seat movable relative to the expandable ring to expand the expandable ring to create a seal between the borehole isolation device and an inner surface of the borehole or the casing at the location; and wherein the bypass fluid flowpath extends across the at least partial seal.

11. The well system of claim 10, wherein the cross-sectional area of the internal bypass fluid flowpath is between 0.01 square inches and 3 square inches.

12. The well system of claim 10, wherein the pressure control device comprises a valve, a nozzle, a tube, or a rupture disc.

13. The well system of claim 10, wherein the expandable ring is further configured to contract from the second outer diameter towards the first outer diameter when when the pressure differential decreases below the level required to create the at least partial seal.

14. The well system of claim 10, wherein the body of the borehole isolation device comprises a mule shoe and the expandable ring is operatively coupled to the mule shoe.

15. The well system of claim 10, wherein the borehole isolation device comprises a dissolvable material.

16. The well system of claim 10, wherein the expandable ring comprises a reduced thickness section at the uphole end portion of the expandable ring.

17. The well system of claim 10, wherein the expandable ring comprises flutes formed on an outer surface of the expandable ring.

18. The well system of claim 17, wherein the combined cross-sectional area of the flutes is between 0.01 square inches and 3 square inches.

19. The well system of claim 10, wherein the borehole isolation device further comprises a sealing element and the expandable ring is operatively coupled to the sealing element.

20. A method comprising:

pumping a borehole isolation device coupled to a setting tool through a borehole by pumping a fluid in the borehole;

controlling a fluid pressure across the expandable ring with a pressure control device of the borehole isolation device located in a bypass fluid flowpath through the setting tool to control the velocity of the borehole isolation device while being pumped through the borehole by controlling an amount of the fluid passing through the bypass fluid flowpath during conveyance of the borehole isolation device to a location in the borehole;

expanding an outermost portion of an expandable ring of the borehole isolation device from a first outer diameter to a second outer diameter that is greater than the first outer diameter of the body due to a pressure differential of the pumped fluid outside the borehole isolation device across the expandable ring being greater on the uphole end to create at least a partial seal between the borehole isolation device and an inner surface of the borehole or a casing in the borehole during conveyance of the borehole isolation device to the location in the borehole; and expanding the expandable ring by moving a seat relative to the expandable ring to create a seal between the borehole isolation device and the inner surface of the borehole or the casing at the location.

21. The method of claim 20, wherein the pressure control device comprises a valve, a nozzle, a tube, or a rupture disc.

22. The method of claim 20, further comprising contracting the expandable ring from the second outer diameter towards the first outer diameter.

23. The method of claim 20, wherein the expandable ring comprises a reduced thickness section at the uphole end portion of the expandable ring.

24. The method of claim 20, wherein the expandable ring comprises flutes formed on an outer surface of the expandable ring.

* * * * *